US011505361B2

(12) United States Patent
Trasacco

(10) Patent No.: US 11,505,361 B2
(45) Date of Patent: Nov. 22, 2022

(54) PLATE POCKET FOR PIZZA BOX

(71) Applicant: Barry Trasacco, West Haven, CT (US)

(72) Inventor: Barry Trasacco, West Haven, CT (US)

(73) Assignee: Barry Trasacco, West Haven, CT (US)

( * ) Notice: Subject to any disclaimer, the term of this patent is extended or adjusted under 35 U.S.C. 154(b) by 235 days.

(21) Appl. No.: 17/000,803

(22) Filed: Aug. 24, 2020

(65) Prior Publication Data

US 2021/0323722 A1 Oct. 21, 2021

Related U.S. Application Data

(63) Continuation-in-part of application No. 16/930,806, filed on Jul. 16, 2020.

(60) Provisional application No. 62/875,637, filed on Jul. 18, 2019.

(51) Int. Cl.

| | |
|---|---|
| ***B65D 5/48*** | (2006.01) |
| ***B65D 85/36*** | (2006.01) |
| ***B65D 5/18*** | (2006.01) |
| ***B65B 5/02*** | (2006.01) |
| ***B65B 5/08*** | (2006.01) |

(Continued)

(52) U.S. Cl.

CPC ..... *B65D 5/48002* (2013.01); *B65B 5/024* (2013.01); *B65B 5/08* (2013.01); *B65B 25/16* (2013.01); *B65D 5/18* (2013.01); *B65D 5/5028* (2013.01); *B65D 85/36* (2013.01); *B65D 2585/366* (2013.01)

(58) Field of Classification Search

CPC B65D 2585/366; B65D 85/36; B65D 5/5028; B65D 5/18; B65D 5/48002; B65D 5/48024; B65D 5/4233; B65D 81/3853; A47G 23/0608; A47G 21/001; A47G 47/14; B65B 5/024; B65B 5/08; B65B 25/16

USPC ..... 206/223, 549, 551, 562, 749; 229/906, 229/103, 120.32, 904, 902; 426/115, 128

See application file for complete search history.

(56) References Cited

U.S. PATENT DOCUMENTS

| | | | | |
|---|---|---|---|---|
| 4,572,423 A * | 2/1986 | Spencer | ..... | B65D 5/0015 206/509 |
| 4,819,862 A | 4/1989 | Maroszek | | |
| 4,836,383 A | 6/1989 | Gordon et al. | | |

(Continued)

FOREIGN PATENT DOCUMENTS

| | | | | |
|---|---|---|---|---|
| CN | 107835772 A * | 3/2018 | ..... | A41D 13/04 |
| FR | 2726812 A1 * | 5/1996 | ..... | B65D 25/205 |

(Continued)

*Primary Examiner* — Christopher R Demeree

(74) *Attorney, Agent, or Firm* — Delio Peterson & Curcio; Brian G. Schlosser

(57) ABSTRACT

A unique pizza box apparatus and methods of forming and using said pizza box are disclosed. The pizza box is formed with an additional plate pocket for receiving plates therein. The pocket is connected to an inside surface of the pizza box lid and expands a distance less than that of the depth of the pizza box. On the pizza box lid is a cut or perforated plate pocket lid with a living hinge on one end and a lid tab on a substantially opposite end for grabbing and rotatably opening the plate pocket lid with respect to the pizza box lid. A pizza bumper may further be included within the box to ensure separation between a base of the plate pocket and a pizza once the pizza is placed within the box. Napkins and/or further utensils may also be placed within the plate pocket if so desired.

12 Claims, 17 Drawing Sheets

(51) Int. Cl.
*B65B 25/16* (2006.01)
*B65D 5/50* (2006.01)

(56) References Cited

U.S. PATENT DOCUMENTS

| | | | | |
|---|---|---|---|---|
| 5,110,038 | A | 5/1992 | Pantisano et al. | |
| 5,509,601 | A | 4/1996 | Drabick | |
| 5,542,540 | A | 8/1996 | Knapp et al. | |
| 6,386,440 | B1 | 5/2002 | Tulkoff | |
| 6,755,711 | B2 | 6/2004 | McClung et al. | |
| 6,899,587 | B2 | 5/2005 | McClung et al. | |
| 6,905,065 | B2 * | 6/2005 | Holden | B65D 5/4295 229/906 |
| 7,222,773 | B2 | 5/2007 | Smith et al. | |
| 8,770,466 | B1 | 7/2014 | Terlesky et al. | |
| 10,166,451 | B1 * | 1/2019 | Laskowitz | A63B 67/06 |
| 11,066,207 | B2 * | 7/2021 | Cavaceppi | B65D 5/5028 |
| 2003/0029769 | A1 * | 2/2003 | Ausaf | B65D 81/113 206/541 |
| 2006/0226206 | A1 | 10/2006 | Reap | |
| 2011/0186621 | A1 | 8/2011 | Parker | |

FOREIGN PATENT DOCUMENTS

| | | | | |
|---|---|---|---|---|
| WO | WO-2011070563 | A1 * | 6/2011 | B65D 85/36 |
| WO | 2015123709 | A1 | 8/2015 | |
| WO | WO-2019030663 | A1 * | 2/2019 | B65D 5/4237 |

* cited by examiner

PLATE POCKET FOR PIZZA BOX

BACKGROUND OF THE INVENTION

1. Field of the Invention

The present invention relates to a system, apparatus and method for packaging and delivering serving plates along with a pizza in the same size as an otherwise standard pizza box.

2. Description of Related Art

Customers who order take-out pizza or pizza for delivery eventually need to have serving plates on which to serve the pizza slices. Currently such serving plates are either not supplied with the take-out or delivered pizza at all, or are packaged separately, in a manner which is often awkward and difficult to handle with the pizza box.

U.S. Patent Application No. 2011/0186621 published to Parker and titled "PIZZA BOX WITH STORAGE COMPARTMENTS" discloses a pizza box with full width storage compartments located on the top and bottom lids of the box for holding paper plates/collapsible cups. These compartments are accessible by removing separate cardboard inserts that are sealed by a peel-off adhesive ring disposed on the top and bottom lids. This requires adhesively binding the inserts to the lids and providing completely separate compartments within the pizza box itself.

It would be advantageous to provide an improved packaging procedure to make the process of accessing the plates easier for end users (e.g. people receiving the delivery/takeout order) and provide a more environmentally friendly solution that does not waste excess cardboard in forming the pizza box.

SUMMARY OF THE INVENTION

Bearing in mind the problems and deficiencies of the prior art, it is therefore an object of the present invention to provide an improved system, apparatus and method for packaging and delivering serving plates along with a pizza in the same size as an otherwise standard pizza box.

It is another object of the present invention to provide a pizza box with a plate pocket formed within the box and having a pocket lid that is formed without necessitating excess cardboard.

Yet another object of the present invention is to provide an improved method for using a pizza box to store pizza, plates and/or napkins and utensils therein.

Still another object of the present invention is to provide an improved method for making a pizza box for storing plates along with a pizza therein.

The above and other objects, which will be apparent to those skilled in the art, are achieved in the present invention which is directed to a pizza box, comprising a base having sidewalls extending perpendicular from its edges, and a lid having a top surface and a bottom surface connected to one of said sidewalls, such that the lid may swing from an open position exposing the inside of the box to a closed position resting adjacent to the sidewalls. A plate pocket extends downwards from the bottom surface of the box lid a distance that is less than the total depth of the box. This plate pocket is sized to receive at least one plate therein. A plate pocket lid is formed from the box lid top surface via a cut or perforations cut into the box lid. A portion of the plate pocket lid is not cut or perforated to act as a living hinge that allows for the plate pocket lid to swing between an open position exposing the inside of the plate pocket to a closed position resting flush with the box lid top surface.

In an embodiment, the pizza box includes a separator disposed within the pizza box to support the pocket when the lid is in the closed position. The plate pocket lid may have dimensions comparable to the plate pocket. A lid tab may be disposed on an end of the plate pocket lid opposite of the living hinge to allow for an easier grip and control of the plate pocket lid when swinging the plate pocket lid about its living hinge. The plate pocket may be formed in a substantially ellipse shape. The plate pocket lid may also be formed in a substantially ellipse shape. Alternatively, the plate pocket may be formed to substantially cover an inside surface of the box lid, such that connecting flaps of the plate pocket adhere to the bottom surface of the box lid, or to foldable flaps or flanges that extend downwardly from a perimeter of the box lid. The plate pocket lid may be formed into a parallelogram shape.

The present invention is further directed to a method of making a pizza box for storing plates alongside a pizza therein. The method provides a pizza box having a base with a top surface and sidewalls extending perpendicular from its edges, and a lid having a top surface and a bottom surface connected to one of said sidewalls, such that the lid may swing from an open position exposing the inside of the box to a closed position resting adjacent to the sidewalls. The method includes the steps of: attaching a plate pocket to the bottom surface of the box lid such that the plate pocket extends downward from the box lid a distance less than the total depth of the pizza box; and cutting a plate pocket lid such that the pocket lid is substantially aligned with the plate pocket, and a portion of the pocket lid is left uncut to act as a living hinge to allow for the pocket lid to rotatably open and close about the box top surface.

In an embodiment, the method further includes the step of cutting a pocket lid tab on an end of the plate pocket lid substantially opposite the pocket lid living hinge. The plate pocket lid may be cut into a substantially ellipse shape. The plate pocket lid may alternatively be cut into a parallelogram shape. The step of cutting the plate pocket lid may further be defined by cutting perforations into the box lid in the shape of the plate pocket lid. The method may further include the step of disposing a separator within the pizza box to suspend a base of the plate pocket above the top surface of the pizza box base.

The present invention is also directed to a method of using a pizza box to store plates and a pizza therein. The method provides a pizza box with a base having sidewalls extending perpendicular from its edges, and a lid having a top surface and a bottom surface connected to one of said sidewalls, such that the lid may swing from an open position exposing the inside of the box to a closed position resting adjacent to the sidewalls; a plate pocket connected to and extending downwards from the box lid a distance less than the total depth of the box, the plate pocket being sized for receiving at least one plate therein; and a plate pocket lid formable from the box lid top surface via a cut or perforations cut into the box lid, wherein a portion of the plate pocket lid is not cut or perforated to act as a living hinge to allow for the plate pocket lid to swing between an open position exposing the inside of the plate pocket to a closed position resting flush with the box lid top surface. The method includes the steps of opening the pizza box lid to expose the plate pocket, and inserting a plate into the plate pocket, placing a pizza within the pizza box base such that the pizza is surrounded by the base sidewalls.

In an embodiment, the method further includes placing a plurality of plates into the plate pocket. The method may further include placing utensils and/or napkins within the plate pocket. The step of inserting the plate into the plate pocket may be achieved by sliding the plate into a gap disposed between the bottom surface of the pizza box lid and a base of the plate pocket. The plate pocket lid may be cut into the pizza box lid, and the step of inserting the plate into the plate pocket may be achieved by opening the plate pocket lid to expose the plate pocket, and inserting the plate into said exposed plate pocket. The method may further include the step of placing a separator on top of the pizza after the pizza is placed within the pizza box, such that the bumper contacts a base of the plate pocket to create a gap between the plate pocket and the pizza to prevent contact between said plate pocket and said pizza.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE EMBODIMENT(S)

In describing the embodiment(s) of the present invention, reference will be made herein to FIGS. 1-18 of the drawings in which like numerals refer to like features of the invention.

The embodiment(s) shown of the system, apparatus and method for packaging and delivering serving plates along with a pizza is constructed of similar cardboard, plastic and otherwise disposable materials in the same dimensions as an otherwise standard pizza box, sized to fit the size of the pizza being delivered. A standard pizza box base is shown throughout each embodiment, but instead of having a normally plain lid, the lid of the pizza box embodiments of the present invention have built-in a pocket for holding the serving plates for the pizza slices. Because serving plates are normally circular, the pocket shown is also circular as seen in a first embodiment in FIGS. 1-7, although other shapes and configurations may be employed to match the serving plates or other contents of the pocket as shown in the alternate embodiments in FIGS. 8-11 and 12-18, respectively. The width or diameter of the plate pocket is sufficient to accommodate the plate size. In addition to serving plates, napkins and utensils such as forks, knives and spoons may also be provided in the plate pocket.

Figure 5:
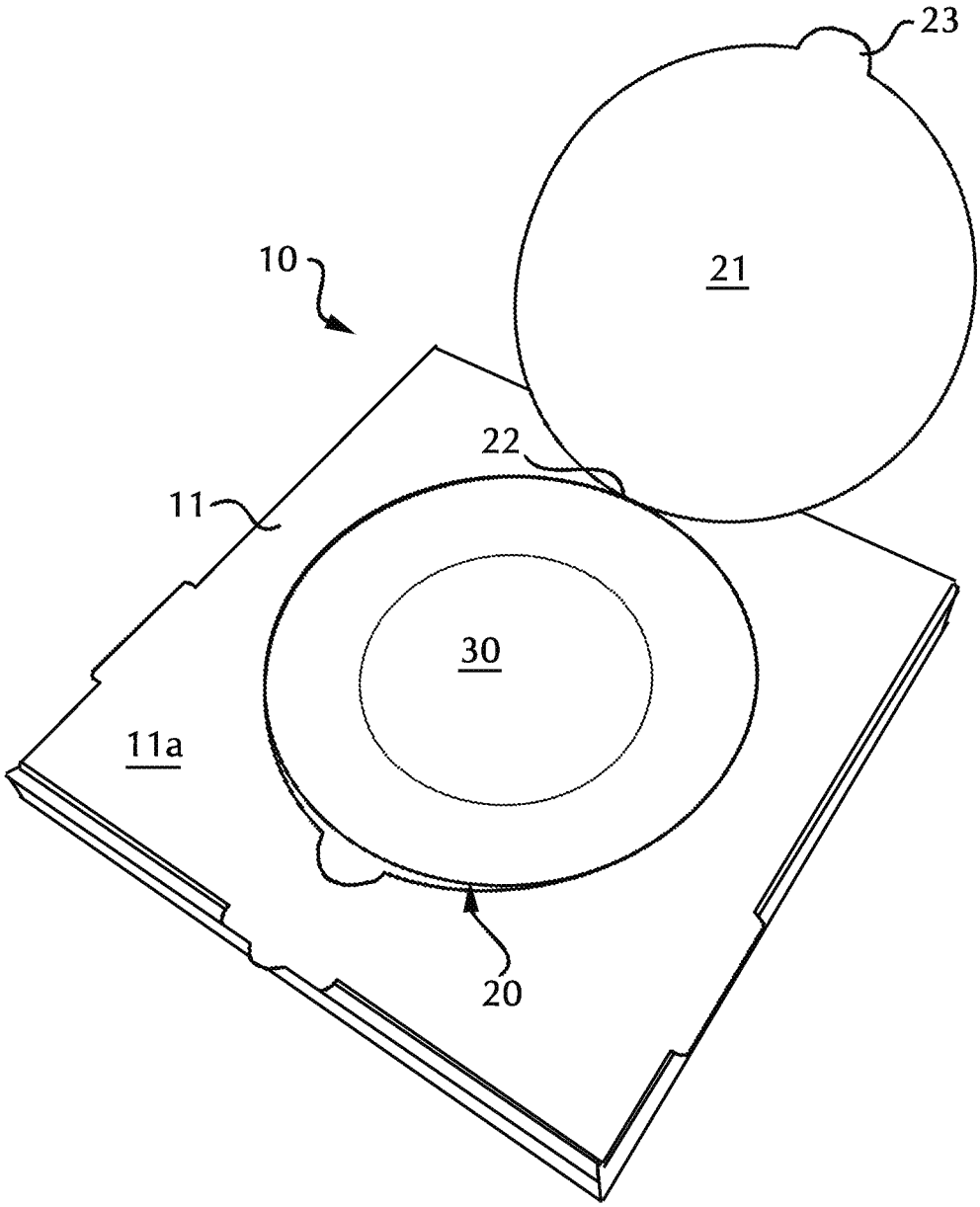
FIG. 5 is a perspective view of the pizza box and plate pocket of FIG. 4, with the lid of the plate pocket in the open position and showing plates disposed within the plate pocket.
Figure 6:
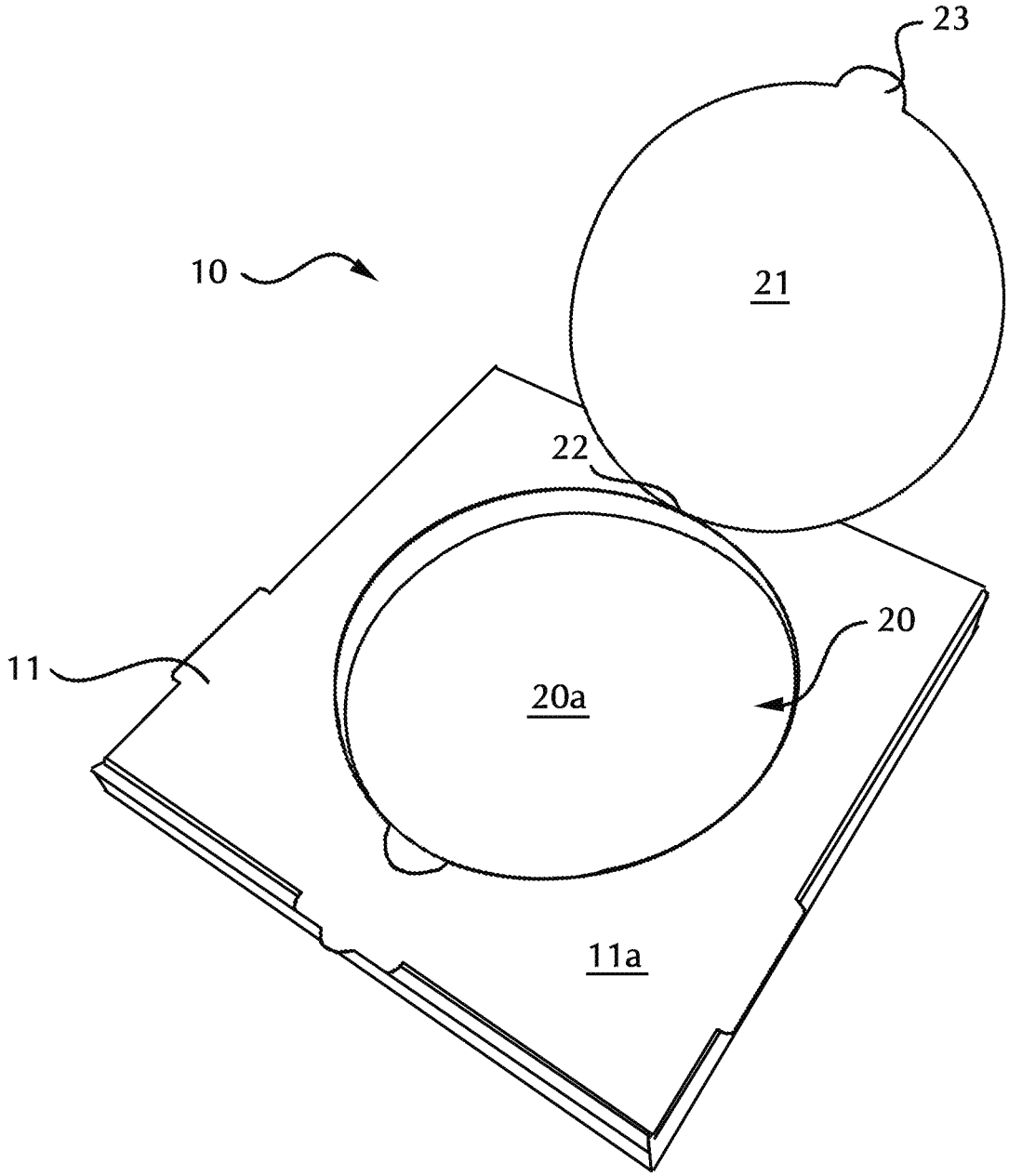
FIG. 6 is a perspective view of the pizza box and plate pocket of FIG. 4, with the lid of the empty plate pocket in the open position.
Figure 7:
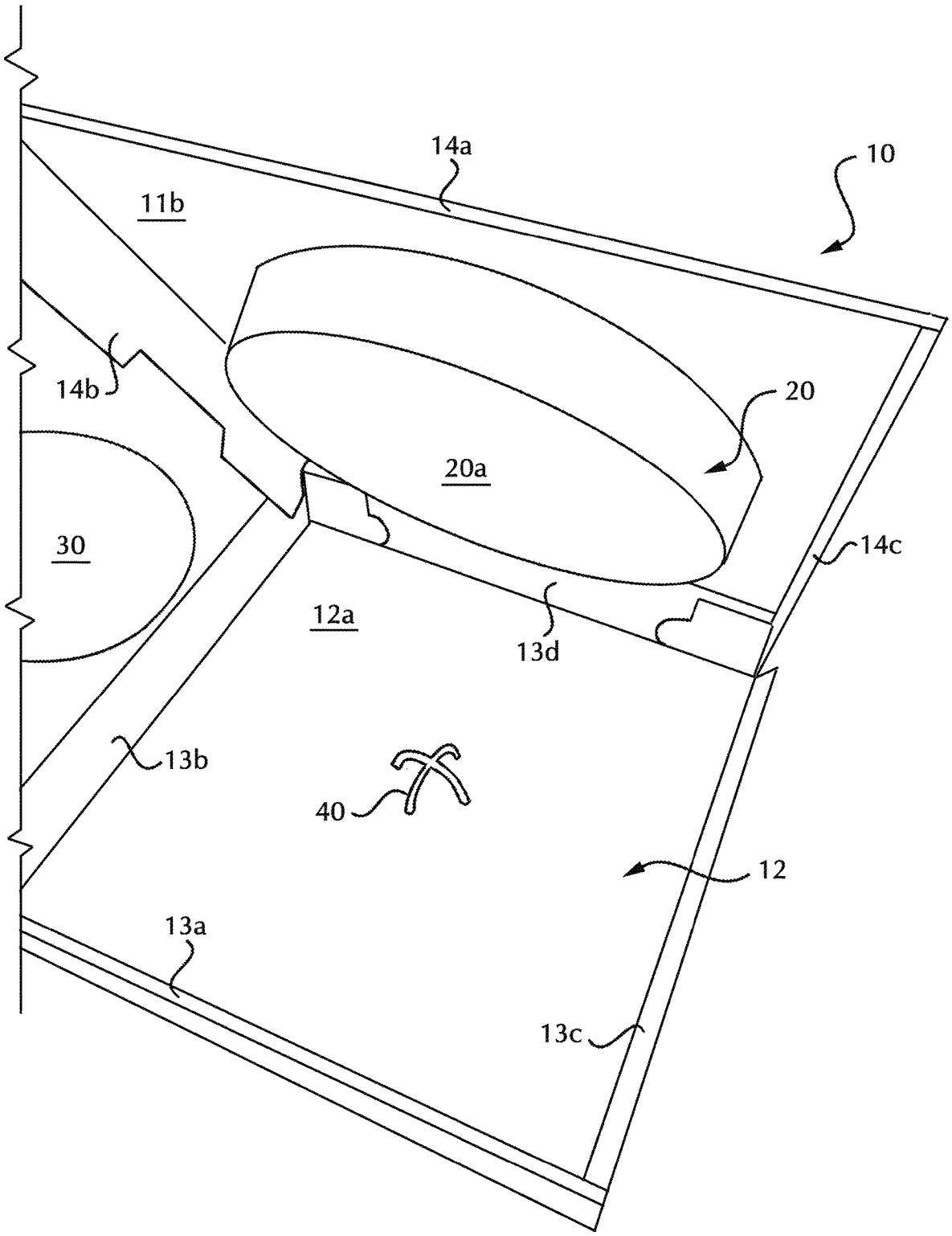
FIG. 7 is a perspective view of the pizza box and plate pocket of FIG. 4, with the lid of the pizza box in the open position.
Figure 8:
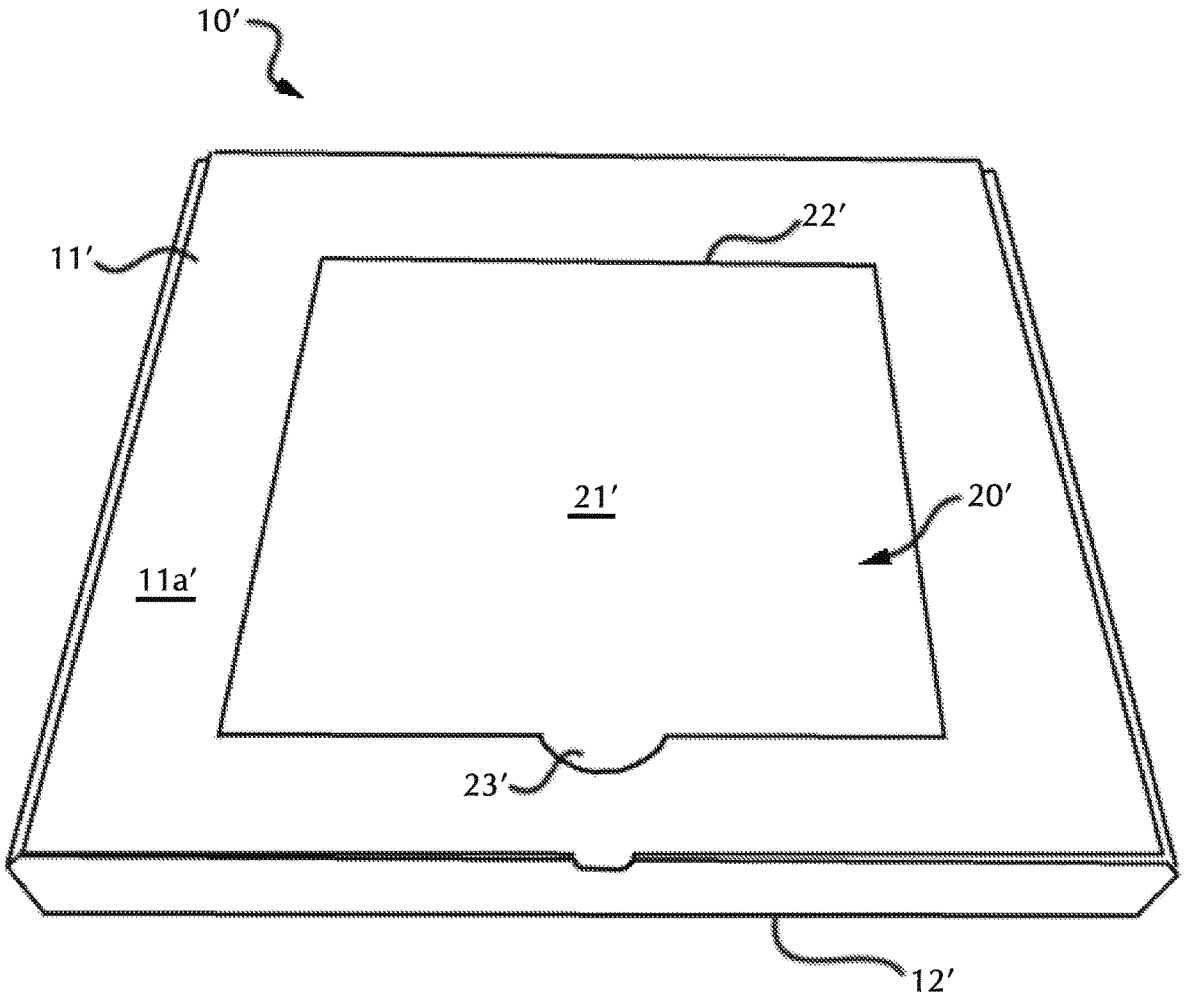
FIG. 8 is a front perspective view of an embodiment of the pizza box and plate pocket of the present invention, with the box lid and pocket lid in the closed positions.
Figure 9:
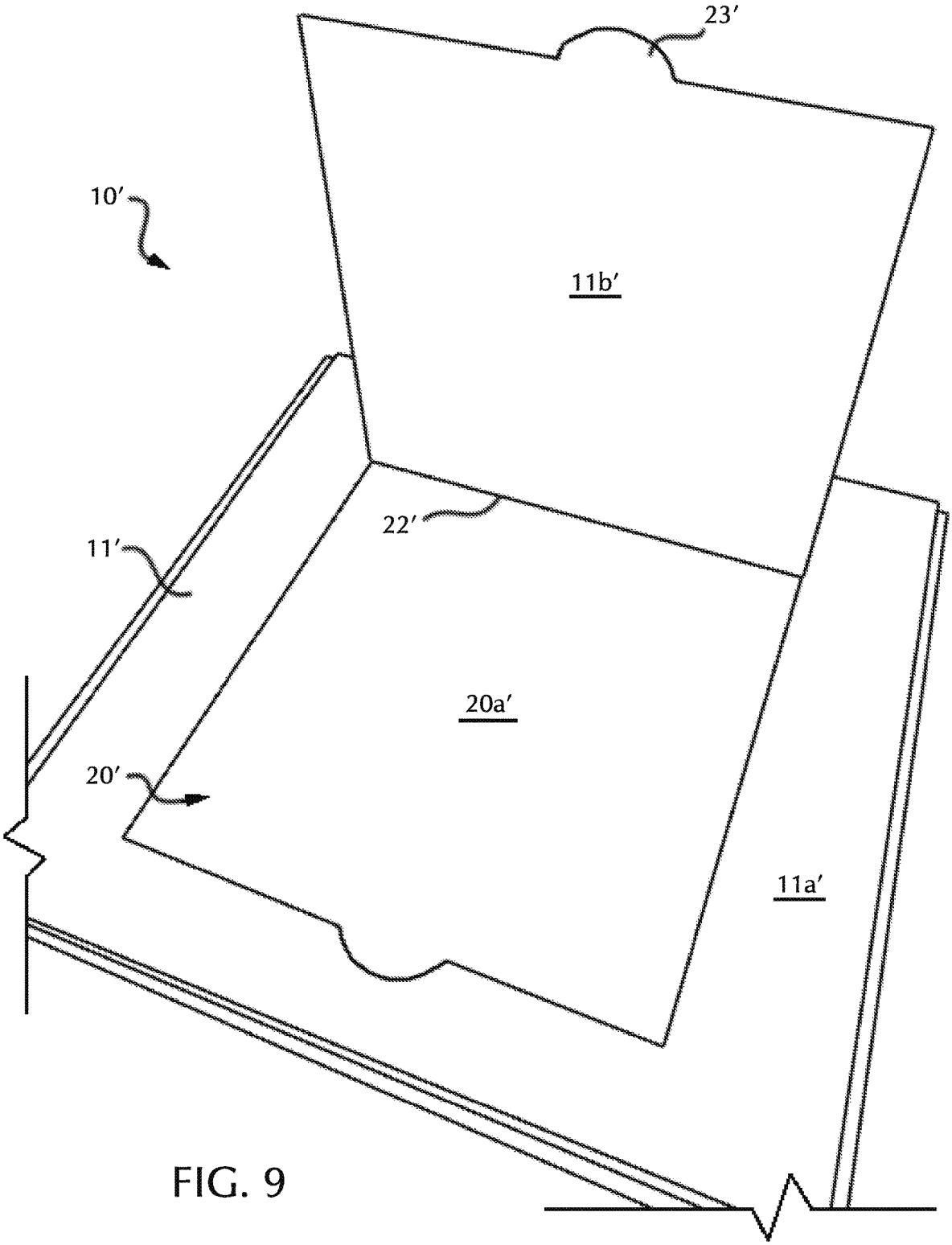
FIG. 9 is a front perspective view of the pizza box and pocket of FIG. 8, with the lid of the empty plate pocket in the open position.

A first embodiment of a pizza box 10 as shown in FIGS. 1-7 has a box lid 11 with a top surface 11*a* and a bottom surface 11*b* facing the inside of the box 10, and a base 12 having a top surface 12*a* facing the inside of the box 10. Box lid 11 includes foldable flaps or flanges 14*a*, 14*b*, 14*c* that extend from the perimeter or edge of the lid 11 and can be folded to extend downwardly from the lid edges. Base 12 includes sidewalls 13*a*, 13*b*, 13*c*, 13*d* extending perpendicular from its edges, with the box lid 11 being connected to sidewall 13*d* as shown in FIG. 7. Foldable flaps or flanges 14*a*, 14*b*, 14*c* of lid 11 nest into and between sidewalls 13*a*, 13*b* and 13*c*. A plate pocket 20 extends downward from the box lid 11*a* distance less than the total depth of the pizza box (i.e. from lid bottom surface 11*b* to base top surface 12*a*), so that there is room below a plate pocket bottom or base 20*a* for a pizza 50. Additionally, the diameter of the plate pocket 20 is less than the width dimensions of the interior of the pizza box 10. The pizza 50 will be able to be disposed between the plate pocket base 20*a* and the box base top surface 12*a*.

Figure 4:
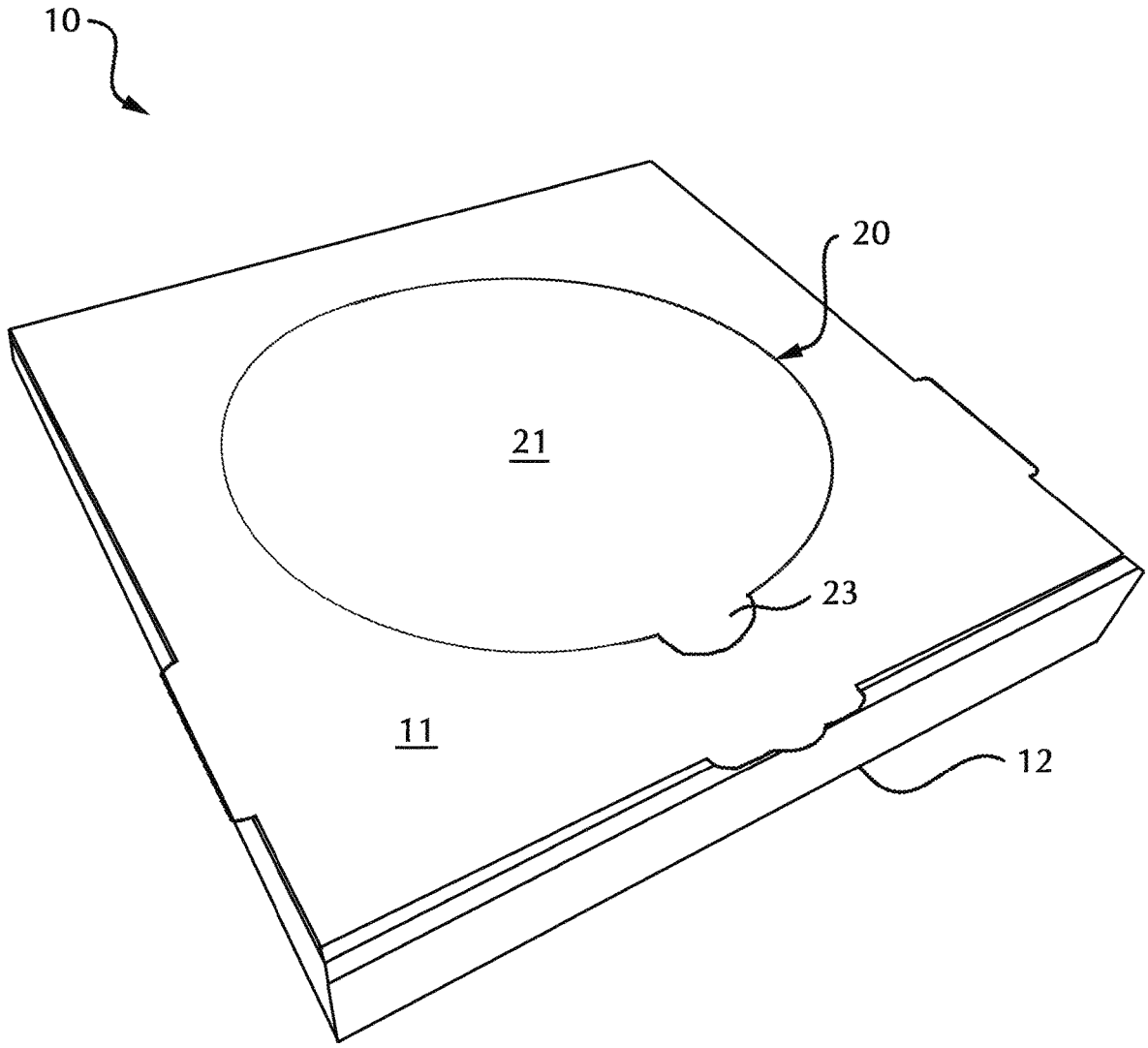
FIG. 4 is a perspective view of an embodiment of the pizza box and plate pocket of the present invention, with the box lid and pocket lid in the closed positions.

A plate pocket lid 21 sits flush with the box top surface 11*a* and is cut or perforated into a substantially ellipse shape, such as that of a circle, or other curved configuration as seen in FIGS. 4-6. At an end of the pocket lid 21 is a lid tab 23 protruding from the pocket lid 21 to provide an end user with an easier grip to open the lid 21. A lid hinge 22 is disposed substantially diametrically opposite from the lid tab 23, and allows the plate pocket lid 21 to be rotatably opened separately from the pizza box lid 11 to provide access to plates 30—or any other utensils/napkins—that may be disposed within the pocket 20.

Figure 1:
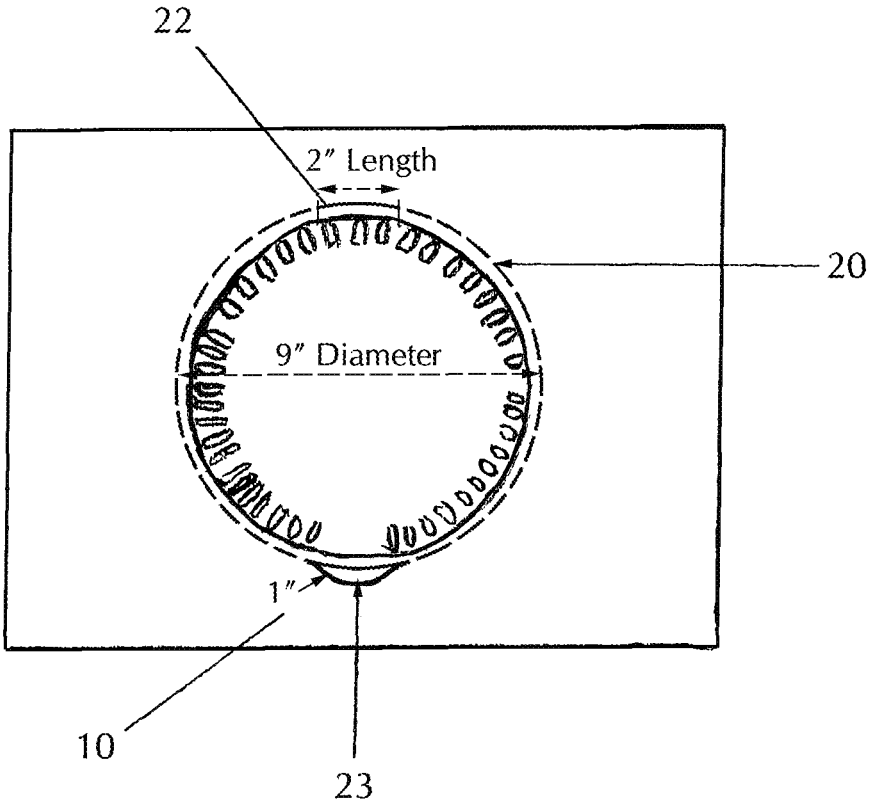
FIG. 1 is a top plan view of an embodiment of the pizza box having the plate holder or pocket in the closed lid of the pizza box, with the cover of the plate pocket in phantom view to show the serving plates stored in the plate pocket.

The plate pocket 20 extends downward from the pizza box lid a distance less than the total depth of the pizza box 10, so that there is room below the plate pocket bottom or base 20*a* for the pizza 50. The depth of the plate pocket will determine the number of plates 30 that may be stacked and secured, and may be about 1 inch in depth, for a typical pizza box depth of 2 inches. The diameter of the plate pocket may be, in the instance of a circular plate pocket as shown in FIG. 1, 9 inches for a standard paper plate, comparable to the diameter of the plate pocket lid. The plate pocket lid 21 is hinged so that the lid 21 may be opened separately from the pizza box lid 11 to access the plates 30. The plate pocket lid 21 may be stamped, cut, or perforated into the pizza box lid 11, except for the lid hinge 22, so that the lid material (typically cardboard) serves as a living hinge. The lid tab 23 may be cut into the plate pocket lid 21 substantially opposite the lid hinge 22 so that a user can grasp it to open the pocket lid 21. The sides and bottom that make up the plate pocket body may be made of any suitable material, such as cardboard or plastic, and secured to the bottom surface 11*b* of the pizza box lid 11 below the plate pocket lid 21, for example, by adhesive or adhesive tape. The plate pocket body extends at its side edges to the bottom surface 11*b* of the pizza box lid 11. The paper, plastic or otherwise disposable serving plates 30 may be loaded into the plate pocket 20 before the plate pocket 20 is secured to the bottom surface 11*b* of the pizza box lid 11. Alternatively, the plates 30 may be loaded into the plate pocket 20 by opening the pocket lid 21 and inserting the plates through the opening in the pizza box lid 11*a*.

Figure 10:
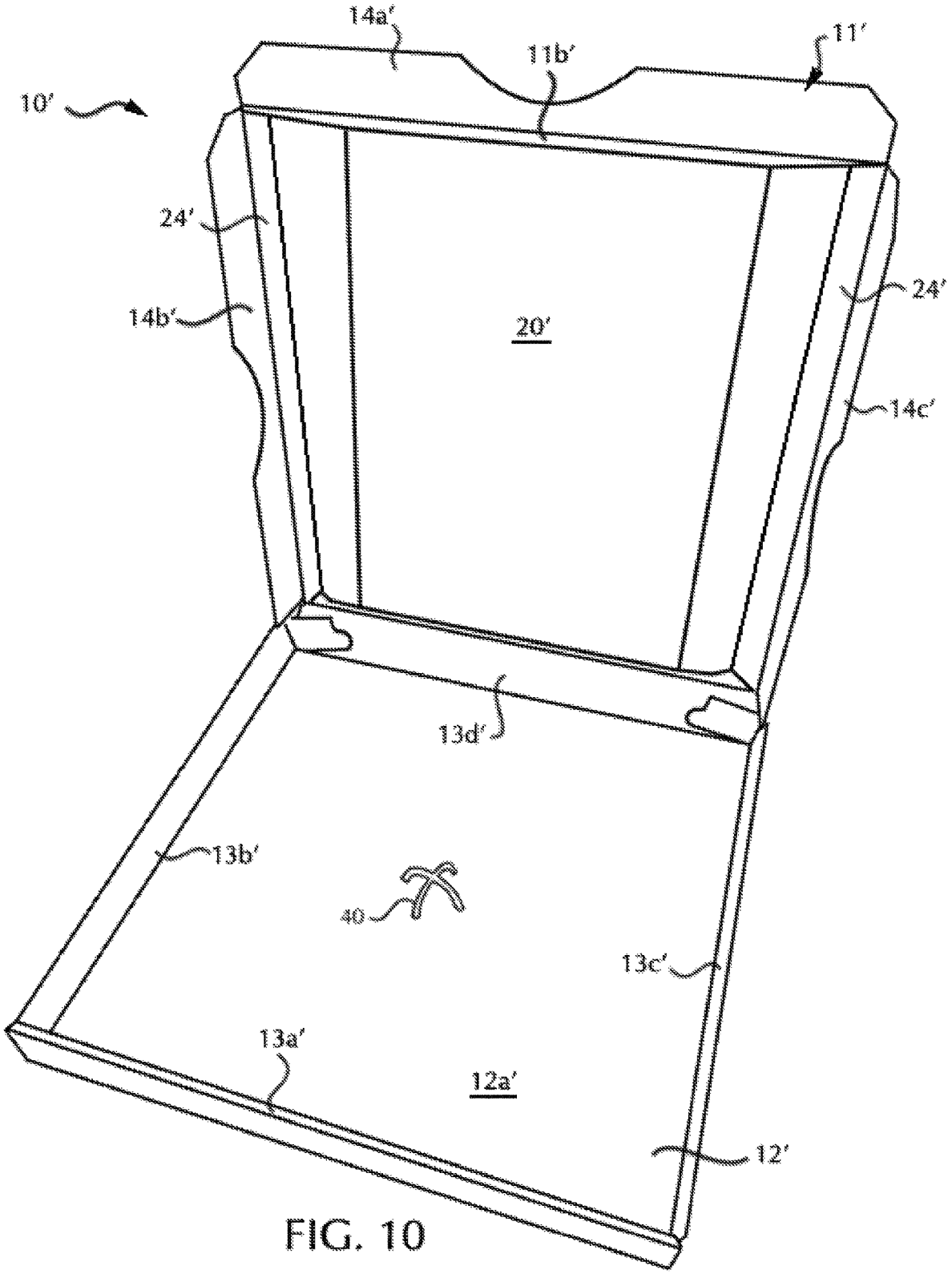
FIG. 10 is a front perspective view of the pizza box and pocket of FIG. 8, with the lid of the pizza box in the open position.

A second embodiment of the pizza box 10' shown in FIGS. 8-11 has a box lid 11' with a top surface 11*a*' and a bottom surface 11*b*' facing the inside of the box 10', and a base 12' with a top surface 12*a*' facing the inside of the box 10'. Box lid 11' includes foldable flaps or flanges 14*a*', 14*b*', 14*c*' that extend from the perimeter or edge of the lid 11' and can be folded to extend downwardly from the lid edges. Base 12' includes sidewalls 13*a*', 13*b*', 13*c*', 13*d*' extending perpendicular from its edges, with the box lid 11' being connected to sidewall 13*d*' as shown in FIG. 10. Foldable flaps or flanges 14*a*', 14*b*', 14*c*' of lid 11' nest into and between sidewalls 13*a*', 13*b*' and 13*c*'. A plate pocket 20' extends downward from the lid 11*a*' distance less than the total depth of the pizza box (i.e. from lid bottom surface 11*b*' to base top surface 12*a*'), so there is room below a plate pocket bottom or base 20*a*' for the pizza. The edges of the plate pocket 20' extend to the bottom surface 11*b*' of the pizza box lid 11', and connecting flaps 24' may be provided at the plate pocket edges to adhere the plate pocket to either bottom surface 11*b*' (stopping at the flaps or flanges 14*b*', 14*c*'), or to the downwardly extending flaps or flanges 14*b*', 14*c*' of lid 11' as shown in FIG. 10. The pizza 50 will be able to be disposed between the plate pocket base 20*a*' and the box base top surface 12*a'*.

A plate pocket lid 21' sits flush with the box top surface 11*a*' and is cut, stamped, or perforated into a parallelogram. At an end of the pocket lid 21' is a lid tab 23' protruding from the pocket lid 21' to provide an end user with an easier grip to open the lid 21'. A lid hinge 22' is disposed substantially opposite from the lid tab 23', and allows the plate pocket lid 21' to be rotatably opened separately from the pizza box lid 11' to provide access to the plates 30—or any other utensils/napkins—that may be disposed within the pocket 20'.

Figure 11:
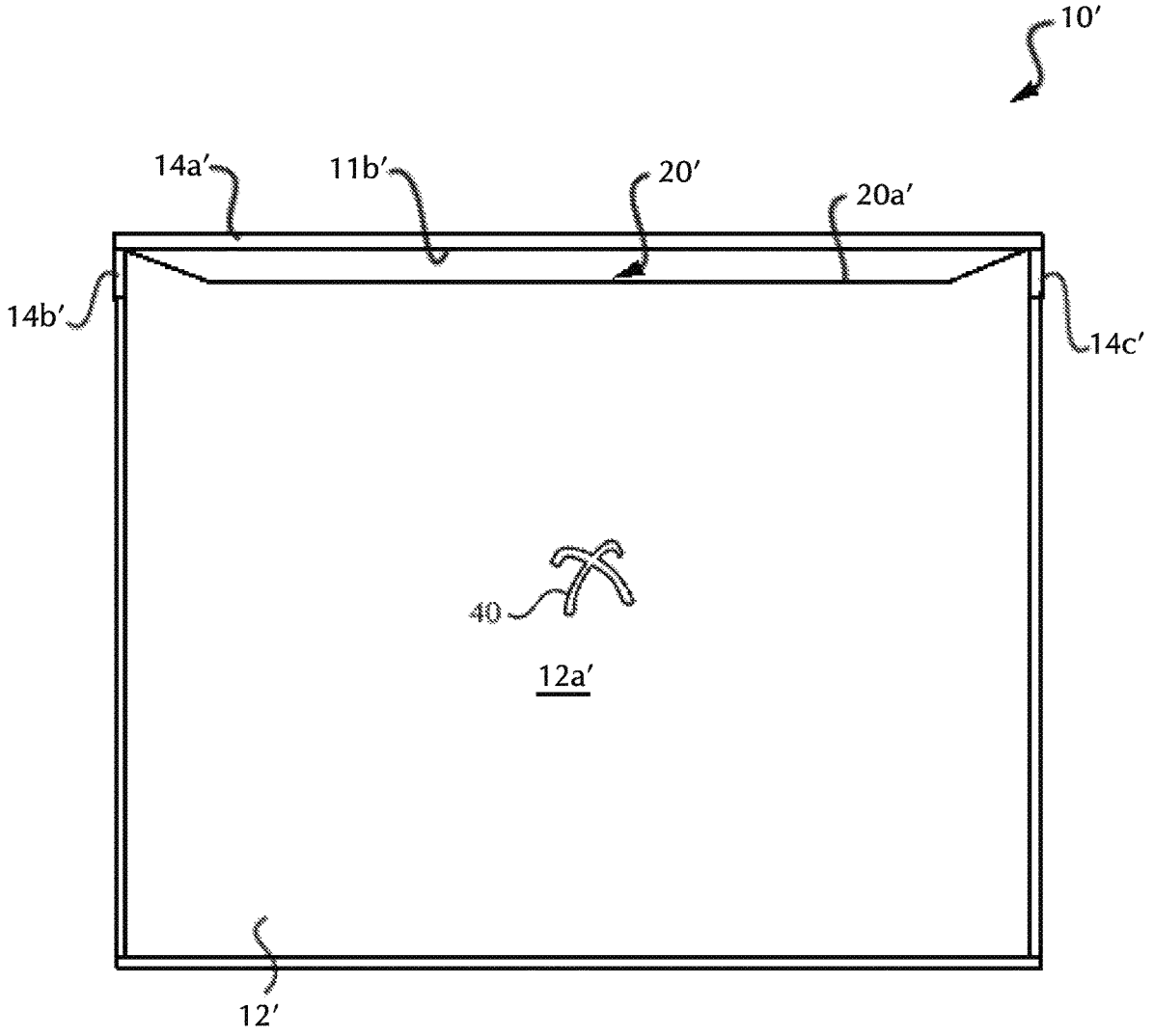
FIG. 11 is a top-down view of the pizza box and pocket of FIG. 8, with the lid of the pizza box open at a 90° angle such that the view is looking directly down into the opening of the plate pocket.
Figure 12:
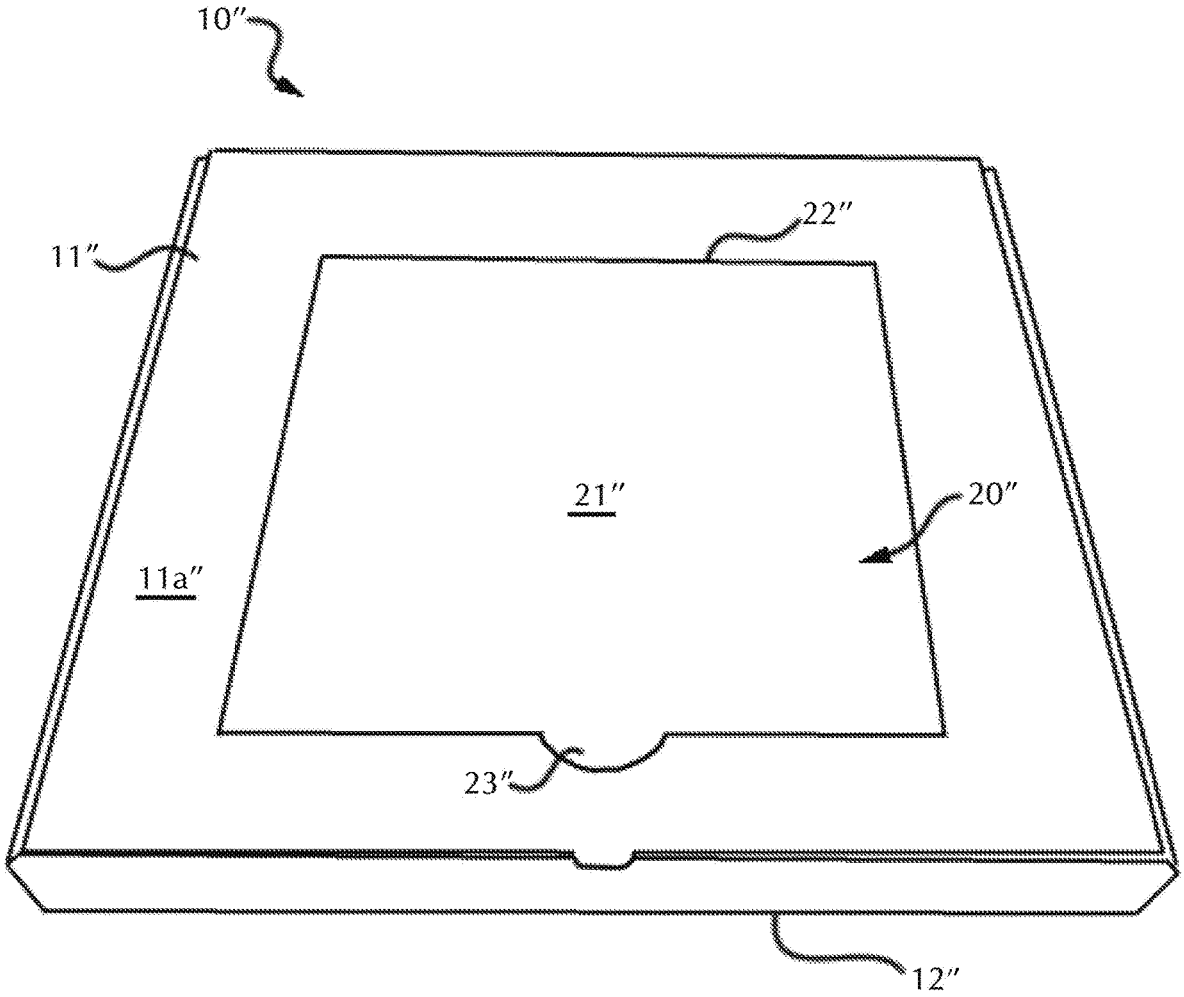
FIG. 12 is a front perspective view of an embodiment of the pizza box and plate pocket of the present invention, with the box lid and pocket lid in the closed positions.
Figure 13:
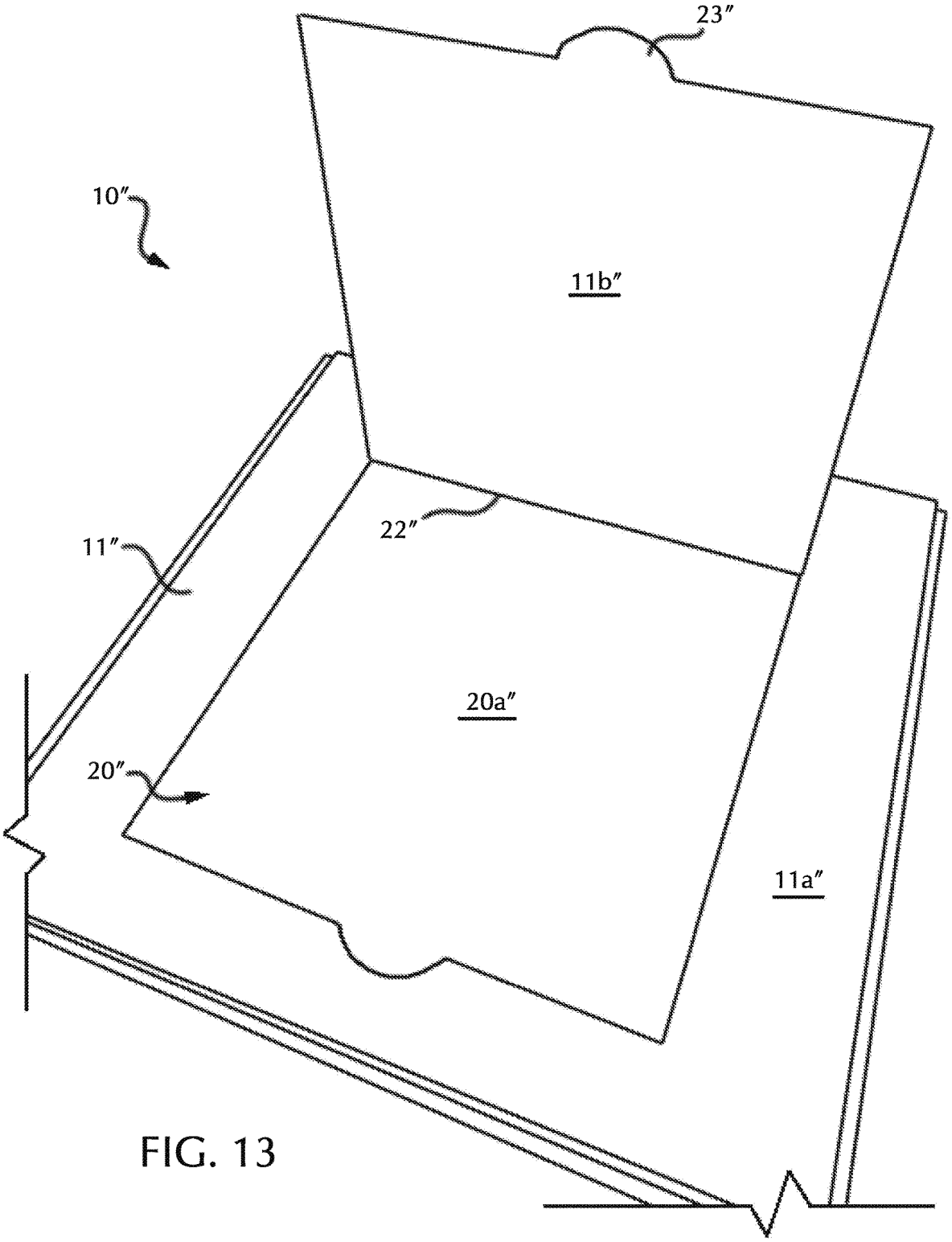
FIG. 13 is a front perspective view of the pizza box and pocket of FIG. 12, with the lid of the empty plate pocket in the open position.

The plate pocket base 20*a*' may expand to cover substantially the entirety of the box lid bottom surface 11*b*', as shown in FIG. 10. Plates 30 may be inserted into the pocket 20' either by opening the pocket lid 21' and inserting the plates through the opening created in the box lid 11', or by opening the box lid 11' and inserting the plates into the pocket 21' through the gap between the box lid bottom surface 11*b*' and pocket plate base 20*a*', as shown in FIG. 11.

The dimensions of the plate pocket lid 21' may be, for example, a 12 in. by 12 in. square, with the pocket lid tab 23' extending at about a ¾ in. length and about a 2 in. width from an edge of the pocket lid 21'. These dimensions are presented merely as examples and should not be interpreted as limiting the present invention as described herein. Other dimensions of the plate pocket 20' and pocket lid 21' may be used to accommodate plates 30 of varying dimensions and/or quantities, and any other utensils/napkins that may be desirable to insert into the pocket 20'.

Figure 14:
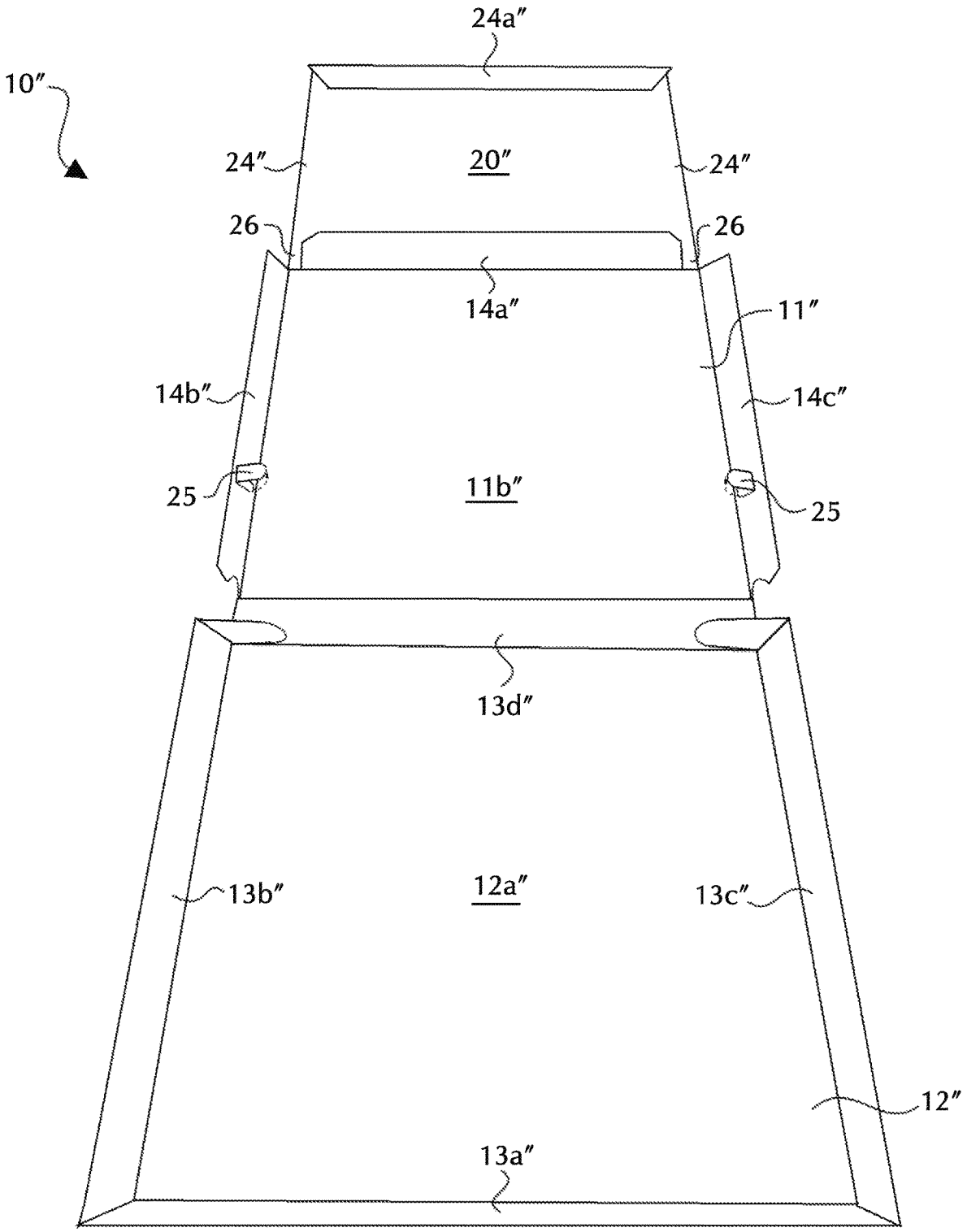
FIG. 14 is a top-down perspective view of the unassembled pizza box of FIG. 12.
Figure 15:
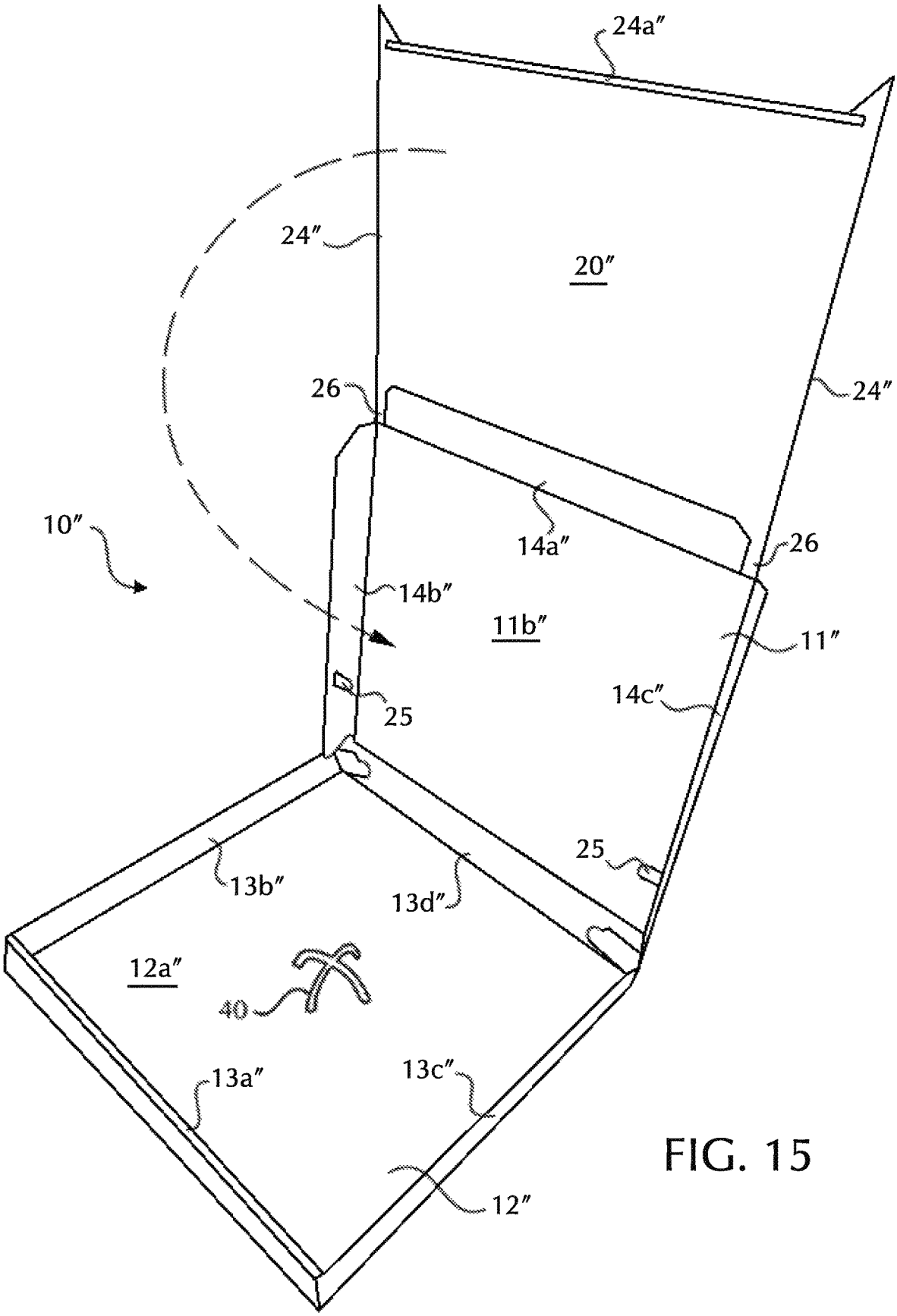
FIG. 15 is a side perspective view of the unassembled pizza box of FIG. 12, showing the folding action of the plate pocket as shown by the arrow.
Figure 16:
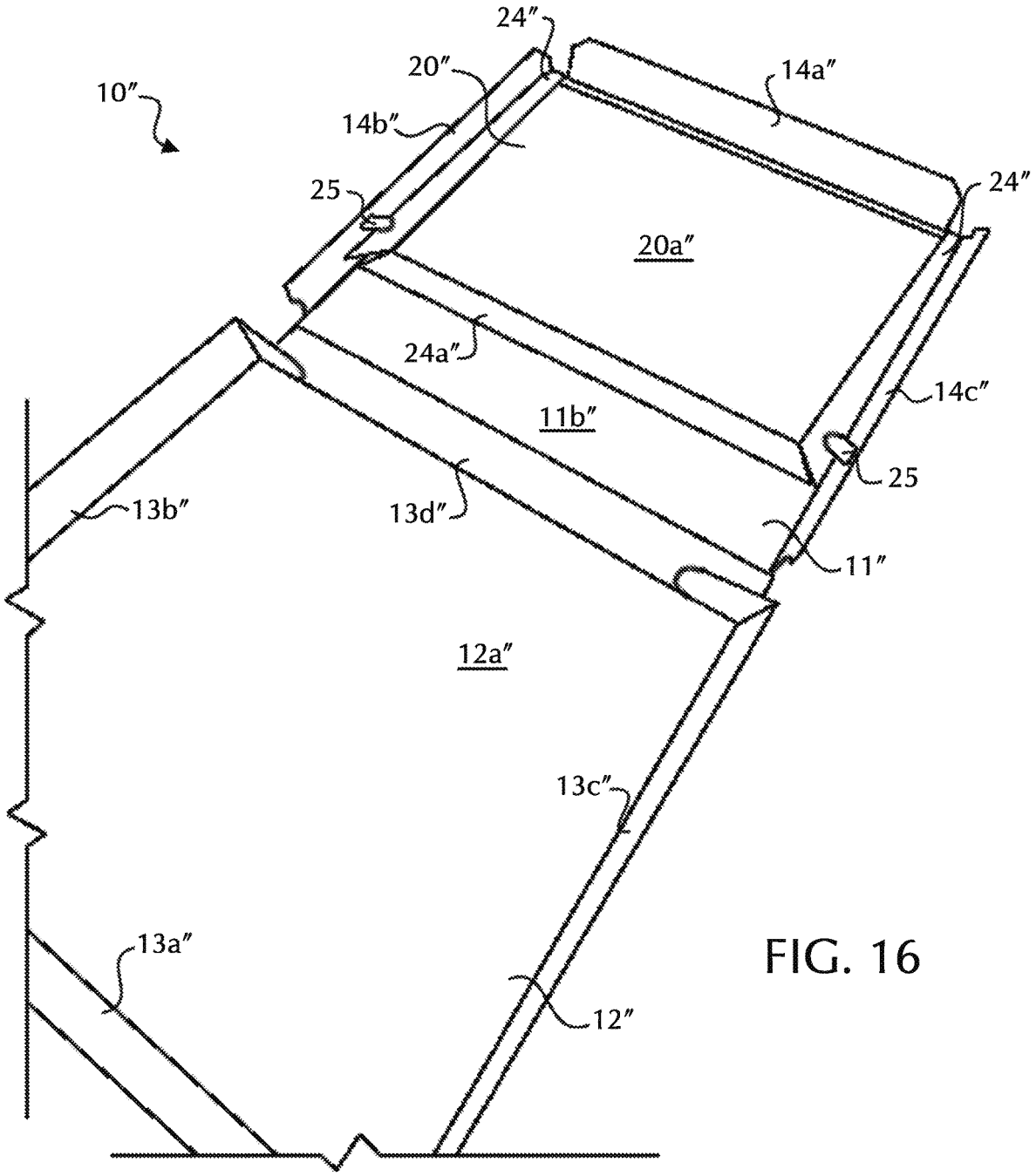
FIG. 16 is a side perspective view of the opened, assembled pizza box of FIG. 12, showing the plate pocket folded into place and the pocket top flap closed.

A third embodiment of the pizza box 10" shown in FIGS. 12-16 has a box lid 11" with a top surface 11*a*" and a bottom surface 11*b*" facing the inside of the box 10", and a base 12" with a top surface 12*a*" facing the inside of the box 10". Box lid 11" includes foldable flaps or flanges 14*a*", 14*b*", 14*c*" that extend from the perimeter or edge of the lid 11" and can be folded to extend downwardly from the lid edges. Base 12" includes sidewalls 13*a*", 13*b*", 13*c*", 13*d*" extending perpendicularly from its edges, with the box lid 11" being connected to sidewalls 13*d*" as shown in FIGS. 14-16. Foldable flaps or flanges 14*a*", 14*b*", 14*c*" of lid 11" nest into and between sidewalls 13*a*", 13*b*", and 13*c*". A plate pocket 20" extends downward from the lid 11*a*" a distance less than the total depth of the pizza box (e.g. from lid bottom surface 11*b*" to base top surface 12*a*") once the box 10" is assembled, so there is room below a plate pocket bottom or base 20*a*" for the pizza. The edges of the plate pocket 20" may extend to the bottom surface 11*b*" of the pizza box lid 11", and pocket flaps 24" may rest at the plate pocket edges either at bottom surface 11*b*", or to the downwardly extending flaps or flanges 14*b*", 14*c*", of lid 11" once the box 10" is assembled, as shown in FIG. 16. The pizza will be able to be disposed between the plate pocket base 20*a*" and the box base top surface 12*a"*.

A plate pocket lid 21" sits flush with the box top surface 11*a*" and is cut, stamped, or perforated into a parallelogram. At an end of the pocket lid 21" is a lid tab 23" protruding from the pocket lid 21" to provide an end user with an easier grip to open the lid 21". A lid hinge 22" is disposed substantially opposite from the lid tab 23", and allows the plate pocket lid 21" to be rotatably opened separately from the pizza box lid 11" to provide access to the plates 30—or any other utensils/napkins—that may be disposed within the pocket 20". The shape and dimensions of plate pocket 20" and pocket lid 21" should not be interpreted as being limited to the parallelogram shapes depicted in FIGS. 12-16, as they can be formed in any other shape suitable for manufacturing needs (e.g. in an ellipse shape as previously disclosed in FIGS. 1-7).

The plate pocket 20" is connected to, and acts as an extension of the lid 11" when the box 10" is unassembled. Foldable flap 14*a*" is cut into the body of pocket 20" such that flap 14*a*" will separate and disconnect from the pocket 20" when the pocket is folded into the interior (e.g. underneath lid 11" to contact lid bottom surface 11*b*", as shown by the arrow in FIG. 15), but remain attached to the lid 11". Connecting members 26 extend from pocket 20" adjacent to pocket flaps 24" and straddle each side of foldable flap **14*a*" so as to keep the plate pocket 20" connected to the lid 11" edge. This configuration thus allows the box 10"** of the present invention to be assembled from one continuous and partially cut/perforated sheet of cardboard (or other boxing material).

Lid flaps **14*b*" and 14*c*" further comprise at least one projection 25 partially cut into each flap, respectively, such that they may be pushed out from the walls of flaps 14*b*", 14*c*" and rotate or swivel inwards (as shown by the arrows in FIG. 14). Once the pocket 20" is folded underneath the lid 11" (such that the pocket base 20*a*" and lid bottom surface 11*b*" are substantially parallel to each other), projections 25 may then be pushed or popped inwards (e.g. inside of the box 10") to rest on the base 20*a*" of the pocket 20" and hold it in place, as shown in FIG. 16. This projection structure thus allows for the plate pocket 20" to be installed within box 10"** without necessitating the need for glue or other adhesives to hold the pocket (and corresponding plates/napkins/utensils disposed therein) within the box, and further prevent it from contacting the pizza.

Pocket flaps 24" may further be folded inward prior to folding the pocket 20" into the lid 11". Doing so will create a barrier within the pocket 20" such that plates, napkins, and/or utensils may remain secure within the pocket once they are inserted. A top pocket flap **24*a*" is also foldable into the pocket to act as a harrier, but may be done so after the pocket 20" is folded underneath the lid and held in place by the projections 25. Plates, napkins, and/or utensils may be placed within the pocket 20" through the opening created by the un-folded top pocket flap 24*a*", and later secured by folding said flap 24*a*" into place (e.g. towards lid bottom surface 11*b*"). Thus, the pizza box 10"** of the present invention presents two different manners in which plates, napkins, and/or utensils may be loaded into the plate pocket—either through the open pocket lid after the box and plate pocket is assembled, or through the plate pocket gap as described above.

Figure 17:
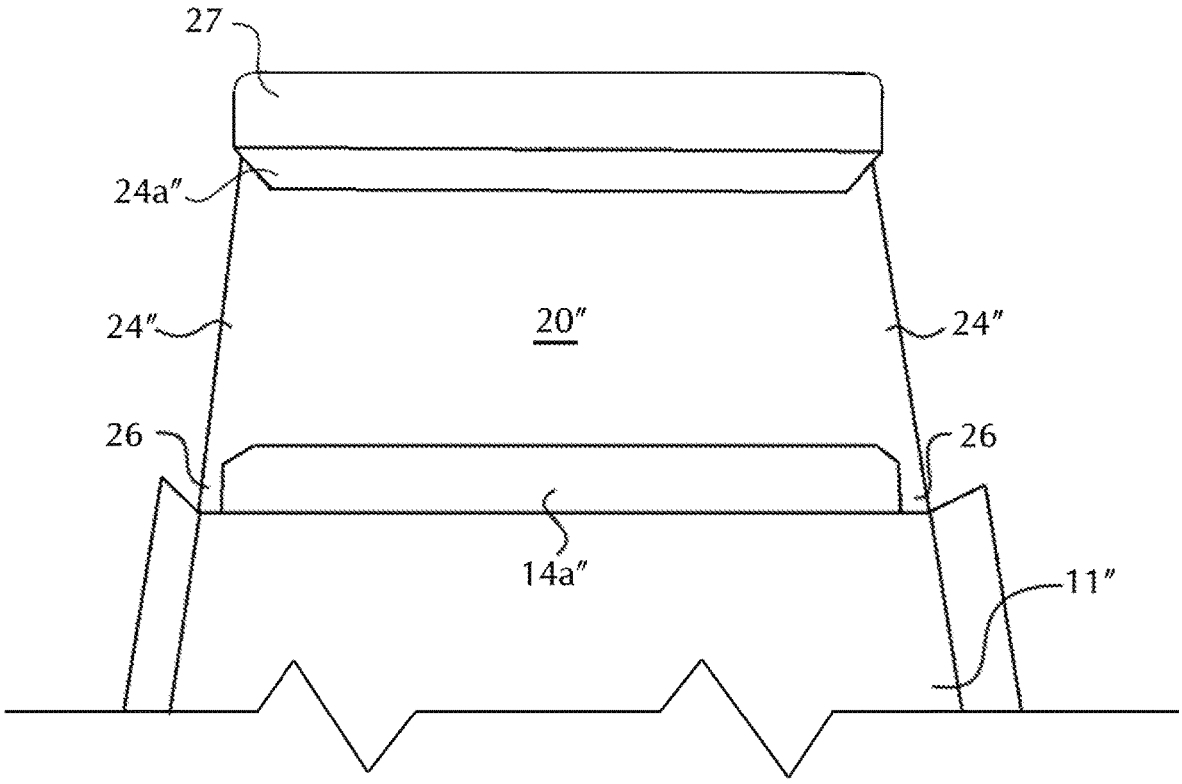
FIG. 17 is a partial, top-down view of the unassembled pizza box and pocket of FIG. 12, showing a foldable extension disposed on a top flap of the plate pocket.
Figure 18:
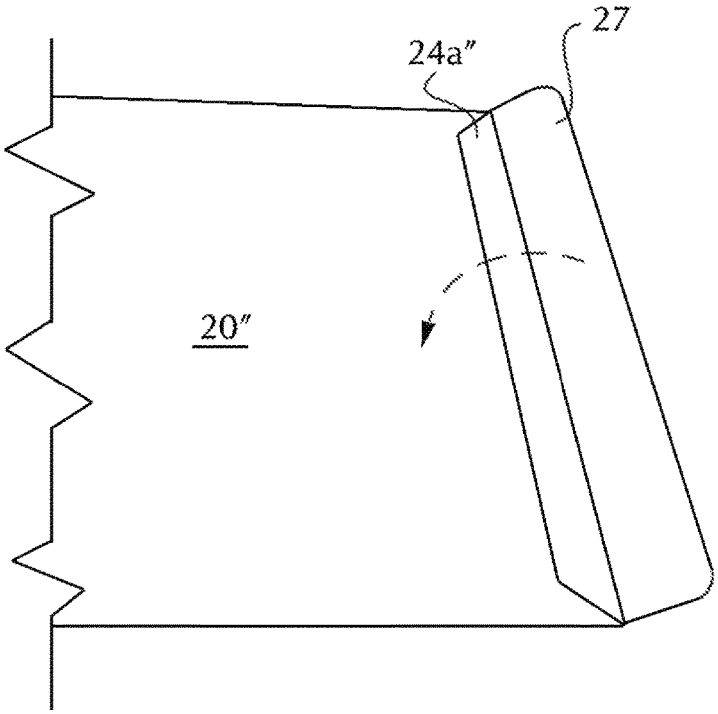
FIG. 18 is a partial side view of the unassembled pizza box and pocket of FIG. 12, showing the folding action of the plate pocket top flap foldable extension of FIG. 17.

In an embodiment, the top pocket flap **24*a*" may further include a foldable extension 27 connected to and extending from the top edge of top flap 24*a*", as shown in FIGS. 17-18. This foldable extension acts as an extra support to ensure the plates, napkins, and/or utensils stay within the pocket 20" once they are placed inside the assembled box. As the top flap 24*a*" is folded into place, the extension 27 is further folded past the angle of top flap 24*a*" (the folding action shown by the arrow in FIG. 18), such that the extension 27 is disposed substantially parallel to the lid bottom surface 11*v*" once the pocket 20" is folded into position. End users may still pull the top pocket flap 24*a*" and extension 27 away from the pocket 20"** after it is folded into place, so as to expose the inside of the pocket and use the opening to insert more plates, napkins, and/or utensils as needed.

The dimensions of the pizza box 10" may present a preferably 14 in.$^2$-22 in.$^2$ box (i.e. base top surface **12*a*" dimensions), or any other dimensions necessary to fit irregular sized pizzas (e.g. small, medium, large, extra-large, party size, sheet, etc.), with the length and width independently varying between 14 in.-22 in. The base 12" sidewalls 13*a*", 13*b*", 13*c*", 13*d*" may have a height ranging from 1 in.-3 in., or any other height needed to fit irregular sized pizzas (e.g. deep-dish, Chicago style, etc.). The lid 11" may have dimensions conforming to those of the base dimensions, preferably 14 in.$^2$-22 in.$^2$, or any other dimensions necessary to fit irregular sized pizzas. The plate pocket 20" may share similar dimensions, having a width equivalent to that of the lid 11"** (i.e. 14 in.-22 in.) and a height slightly less than the lid height (i.e. 14 in.-22 in.). The plate pocket dimensions may also vary to fit irregular sized plates, napkins, utensils, etc.

The downwardly extending flaps or flanges **14*a*", 14*b*", 14*c*" of lid 11" may have a height of 1 in.-3 in., generally conforming to the height of base 12" sidewalls 13*a*", 13*b*", 13*c*", 13*d*". The length of flaps 14*b*", 14*c*" will be equivalent to that of the lid height (i.e. 14 in.-22 in.), and the length of flap 14*a*" will be equivalent to that of the lid width (i.e. 14 in.-22 in.). The at least one projection 25 may be disposed 1 in.-4 in. from the bottom edge of flaps 14*a*" and/or 14*b*" (measuring from flap bottom edge to closest edge of the at least one projection 25), and ½ in.-1½ in. from the flap side edge to the connecting portion of the at least one projection 25 (i.e. the swivel point of the projection 25; where it is connected to the flaps 14*a*" and/or 14*b*"). The at least one projection 25 itself may have a width between ½ in.-1½ in. The plate pocket 20" may have dimensions preferably between 10 in.$^2$-18 in.$^2$, or any other dimensions necessary to fit irregular sized plates, napkins, and/or utensils, with the height and width of the plate pocket independently varying between 10 in.-18 in. The dimensions of the plate pocket 20" will depend on the dimensions of the lid 11", such that the plate pocket may properly be cut into the lid 11"** without compromising the lid integrity.

The connecting members 26 of the plate pocket may have a width between 1 in.-3 in., measured from the edge of pocket flaps 24" to the edge of lid flap **14*a*". The top pocket flap 24*a*"** may have a height between ½ in.-2 in., or any other measurement as needed to accommodate larger/smaller stacks of plates, napkins, etc.

Figure 2:
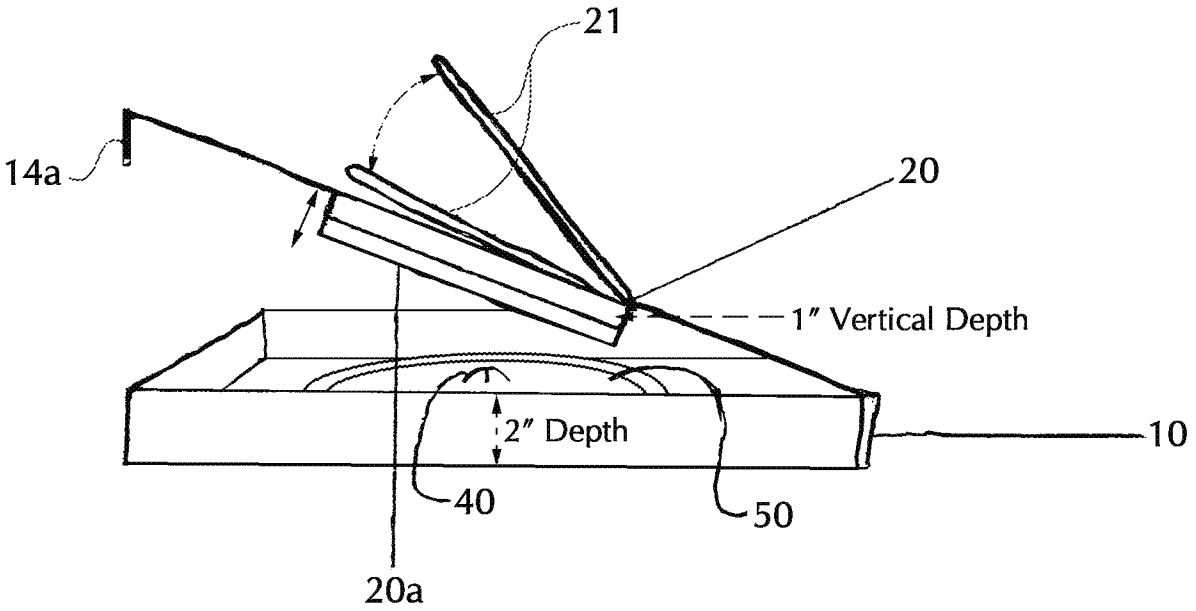
FIG. 2 is a side view, partially in perspective, of the pizza box of FIG. 1 with the pizza box lid partially open, and a side elevational view of the plate pocket extending downward from the pizza box lid, and the plate pocket cover in various stages of opening.
Figure 3:
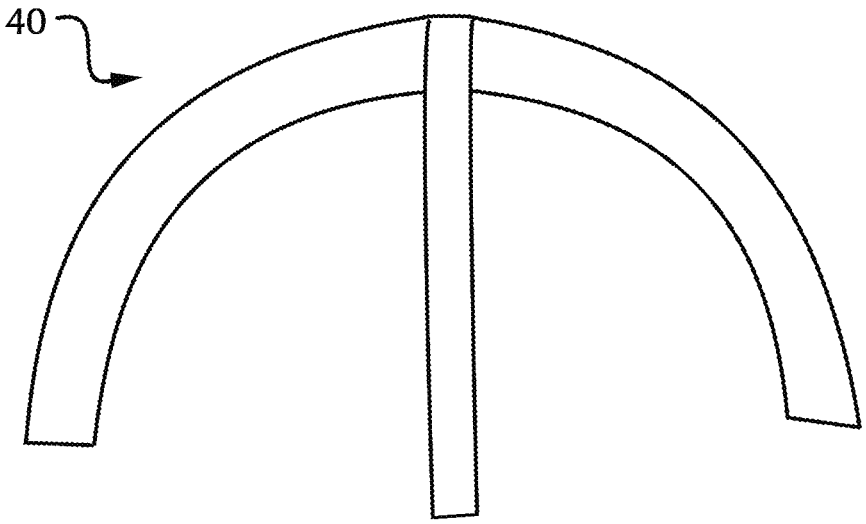
FIG. 3 is a front perspective view of the pizza separator or bumper shown in FIG. 2.

To keep proper separation of the pizza from the base **20*a*, 20*a*', 20*a*" of the plate pocket 20, 20', 20", a pizza separator or bumper 40 is employed. In the embodiment shown in FIG. 3, the pizza separator or bumper 40 has four curved legs extending outwardly in a cross-pattern and down from an upper connection point. In side view the legs have a downward concave configuration. The bumper 40 is placed in the pizza box after the pizza is inserted into the box 10, 10', 10" such that the bumper 40 legs rest on top of the pizza, and the upper point contacts and supports the plate pocket base 20*a*, 20*a*', 20*a*". The total height of the pizza separator or bumper is the difference between the depth of the plate pocket 20, 20', 20" and the height of the pizza box 10, 10', 10", which may be about 1 inch as shown in FIG. 2. The legs may be made of plastic, for example, having a thickness of about ⅛ inch. The pizza box of the present invention may be made with the pizza box lid 11, 11', 11" integral with the pizza box base 12, 12', 12"**, and using the same folded side templates employed in otherwise conventional pizza boxes, and may be shipped to the restaurant unfolded for assembly when needed, in the manner now typically used.

Thus, the present invention provides an improved system, apparatus and method for packaging and delivering serving plates along with a pizza in the same size as an otherwise standard pizza box.

While the present invention has been particularly described, in conjunction with one or more specific embodiments, it is evident that many alternatives, modifications and variations will be apparent to those skilled in the art in light of the foregoing description. It is therefore contemplated that claims to the invention will embrace any such alternatives, modifications and variations as falling within the true scope and spirit of the present invention.

Thus, having described the invention, what is claimed is:

1. A method of assembling a pizza box for storing plates alongside a pizza therein, comprising:

providing a pizza box having a base having a top surface and sidewalls extending from its edges capable of being folded into a position perpendicular to said base, a lid having a top surface and a bottom surface connected to one of said base sidewalls, such that the lid may swing from an open position exposing the inside of the box to a closed position resting adjacent to the sidewalls, the lid further having foldable flaps extending from its perimeter, and a plate pocket extending from and attached to an edge of the lid via connecting members, the plate pocket further having pocket flaps extending from its edges;

folding the plate pocket into the lid such that the plate pocket surface is substantially parallel to a bottom surface of the lid;

folding the lid foldable flaps inwards to a position substantially perpendicular to the lid bottom surface and adjacent to the pocket flaps;

pushing at least one projection inward from the lid foldable flaps so as to contact a base of the plate pocket and hold the plate pocket in place; and cutting a plate pocket lid into the box lid such that the pocket lid is substantially aligned with the plate pocket, and a portion of the pocket lid is left uncut to act as a living hinge to allow for the pocket lid to rotatably open and close about the box top surface.

2. The method of claim 1 further including the step of cutting a pocket lid tab on an end of the plate pocket lid substantially opposite the pocket lid living hinge.

3. The method of claim 1 further including a top pocket flap distinguishable from the other pocket flaps, wherein the top pocket flap remains unfolded after the step of folding the plate pocket into the lid to allow for insertion of plates, napkins, and other utensils.

4. The method of claim 3 wherein the top pocket flap is folded inwards in relation to the lid bottom surface after the insertion of the plates, napkins, and other utensils.

5. The method of claim 1 wherein the step of cutting the plate pocket lid is further defined by cutting perforations into the box lid in the shape of the plate pocket lid.

6. The method of claim 1 further including a plurality of projections disposed on said lid foldable flaps.

7. A method of using a pizza box to store plates and a pizza therein, comprising:

providing a pizza box with a base having sidewalls extending perpendicular from its edges, and a lid having a top surface, a bottom surface connected to one of said sidewalls, and foldable flaps extending from the box lid perimeter, said foldable flaps having at least one projection cut into said foldable flaps which may be pushed to swivel inwards, such that the lid may swing from an open position exposing the inside of the box to a closed position resting adjacent to the sidewalls;

providing a plate pocket connected to and extending downwards from the box lid a distance less than the total depth of the box and further having a top pocket flap which may be left unfolded, the plate pocket secured in place by the at least one projection of the lid foldable flaps, the plate pocket further being sized to receive at least one plate therein; and providing a plate pocket lid formable from the box lid top surface via a cut or perforations cut into the box lid, wherein a portion of the plate pocket lid is not cut or perforated to act as a living hinge to allow for the plate pocket lid to swing between an open position exposing the inside of the plate pocket to a closed position resting flush with the box lid top surface;

opening the pizza box lid to expose the plate pocket;

inserting a plate into the plate pocket; and placing a pizza within the pizza box base such that the pizza is surrounded by the base sidewalls.

8. The method of claim 7 further including placing a plurality of plates, napkins, and utensils into the plate pocket through the opening created by the unfolded top pocket flap.

9. The method of claim 8 further including the step of folding the plate pocket top pocket flap inwards in relation to the lid bottom surface after inserting the plurality of plates, napkins, and utensils into said plate pocket.

10. The method of claim 7 further including placing a plurality of plates, napkins, and utensils into the exposed plate pocket through the opening created by the plate pocket lid being in the open position.

11. The method of claim 7 further including a plurality of projections for securing the plate pocket in place.

12. The method of claim 7 further including the step of placing a separator on top of the pizza after the pizza is placed within the pizza box, such that the bumper contacts a base of the plate pocket to create a gap between the plate pocket and the pizza to prevent contact between said plate pocket and said pizza.

* * * * *